US005373782A

United States Patent [19]

Stewart et al.

[11] Patent Number: 5,373,782

[45] Date of Patent: Dec. 20, 1994

[54] CAR CRUSHING AND LOADING ATTACHMENT FOR FRONT LOADER

[76] Inventors: Wilbur Stewart; Eric R. Stewart, both of R.R. #1, P.O. Box 372, Monroe City, Ind. 47557

[21] Appl. No.: 233,935

[22] Filed: Apr. 28, 1994

[51] Int. Cl.[5] ..... B30B 7/00; B30B 9/32

[52] U.S. Cl. ..... 100/233; 100/901

[58] Field of Search ..... 100/100, 233, 901

[56] References Cited

U.S. PATENT DOCUMENTS

| | | | |
|---|---|---|---|
| 2,682,347 | 6/1954 | Jackson . | |
| 2,705,084 | 3/1955 | Willford . | |
| 2,875,912 | 3/1959 | Thresher et al. . | |
| 3,228,166 | 1/1966 | Thiele . | |
| 3,242,851 | 3/1966 | Brawley et al. . | |
| 3,796,151 | 3/1974 | Williams | 100/901 X |
| 4,188,876 | 2/1980 | Graves | 100/901 X |
| 4,369,700 | 1/1983 | Flagg | 100/901 X |
| 4,441,415 | 4/1984 | Hawkins | 100/901 X |
| 4,442,766 | 4/1984 | Hawkins | 100/901 X |
| 4,467,716 | 8/1984 | Woods et al. | 100/901 X |
| 4,487,120 | 12/1984 | Barstow | 100/100 X |
| 4,697,509 | 10/1987 | LaBounty | 100/233 |

FOREIGN PATENT DOCUMENTS

| | | | |
|---|---|---|---|
| 1502527 | 11/1967 | France | 100/233 |
| 7605096 | 11/1976 | Netherlands | 100/901 |
| 191942 | 3/1967 | U.S.S.R. | 100/100 |

*Primary Examiner*—Stephen F. Gerrity

*Attorney, Agent, or Firm*—Jacobson, Price, Holman & Stern

[57] ABSTRACT

A crushing attachment is provided for removable support from the lift arms of a front loader and the attachment includes a pair of horizontally spaced apart forwardly projecting lower support arms which taper forwardly in height. The attachment also includes a pair of forwardly projecting crusher arms spaced above and in vertical alignment with the support arms and pivotally supported relative to the support arms for vertical swinging about a horizontal transverse axis extending between the rear ends of the crusher arms. The crusher arms are interconnected by a plurality of reinforcing bars extending and secured therebetween at points spaced longitudinally along the crusher arms and hydraulic cylinders are operatively connected between the crusher arms and the support arms for angularly displacing the crusher arms relative to the support arms.

7 Claims, 3 Drawing Sheets

CAR CRUSHING AND LOADING ATTACHMENT FOR FRONT LOADER

BACKGROUND OF THE INVENTION

1. Field of the Invention

This invention relates to a car crushing and loading attachment for mounting from the lift arms of a front loader equipped with parallelogram linkage structure for stabilizing a lifting assembly pivotally supported from the lift arms. The car crushing and loading attachment includes upper and lower pairs of laterally spaced apart crusher and support arms in vertical registry with each other and while the lower support arms are free of interconnecting structure extending therebetween, the crusher arms are interconnected by a plurality of transverse braces or bars extending therebetween at points spaced longitudinally therealong. Furthermore, the lower support arms are rigidly supported and project forwardly of opposite side lower marginal portions of a transverse frame to be removably supported from the support arms of the attendant front loader and the upper crusher arms are pivotally supported from corresponding opposite side upper marginal portions of the frame, fluid motor structure being operatively connected between the frame and the upper crusher arms for forcibly swinging the forward ends of the crusher arms toward and away from the forward ends of the lower support arms.

DESCRIPTION OF RELATED ART

Various different forms of load clamping and lifting structures heretofore have been provided for mounting upon the forward ends of various different forms of land vehicles and also from lift booms mounted from land vehicles. Examples of these previously known structures are disclosed in U.S. Pat. Nos. 2,875,912, 3,242,851, 4,441,415, 4,442,766 and 4,697,509.

However, these previously known structures are not specifically adapted to be used in conjunction with a highly maneuverable wheeled front loader of the articulated type. This type of front loader may be tightly maneuvered among a plurality of ground supported junked vehicles and, through the utilization of the car crushing and loading attachment of the instant invention, accomplish rapid crushing, carrying and stacking of crushed junk vehicles upon a transport for transportation to a distant locality.

SUMMARY OF THE INVENTION

The car crushing and loading attachment of the instant invention has been specifically designed to be used in conjunction with a highly maneuverable wheeled front loader of the articulated type which may be rapidly moved among a plurality of ground supported junked vehicles disposed upon the ground in random pattern and with the front loader, through utilization of the car crushing and loading attachment, being readily operable to quickly forwardly slide the free ends of the lower support arms of the attachment beneath a vehicle and to thereafter downwardly swing the crushing arms of the attachment in order to vertically compress the portions of the vehicle engaged between the support and crusher arms. The usual practice is to engage and vertically compress (crush), in succession, first and second ends of a selected vehicle and then to engage and vertically compress the longitudinal midportion of the selected vehicle while at the same time lifting the vehicle from the ground and maneuvering the front loader over the ground to position the crushed vehicle upon a transport vehicle. In this manner, minimum time is wasted and full usage of the front loader and the operator thereof is enabled.

The main object of this invention is to provide a car crushing and loading attachment for the lift arms and parallel linkage stabilizing arms of a wheeled front loader of the articulated type.

Another object of this invention is to provide a car crushing and loading attachment in accordance with the preceding objects and including features thereof which greatly assist multiple engagements of the crushing attachment with a vehicle to be crushed and transported to and loaded upon a transport vehicle.

Still another object of this invention is to provide a car crushing and loading attachment which may be readily adapted to semipermanent mounting pin mounting from the lift arms of a wheeled front loader as well as adapted for ready removable mounting from the lift arms of a front loader through utilization of quick connect structures of various types presently available.

Another very important object of this invention is to provide a car crushing and loading attachment which will be operative to selectively engage and pickup a selected vehicle from a pile of junked vehicles.

A further object of this invention is to provide a car crushing and loading attachment for a wheeled front loader and with the attachment including structural features thereof enabling the attachment to readily grip and lift junked cars disposed upon soft ground downwardly into which the frames or bodies of the cars may have been partially recessed.

A final object of this invention to be specifically enumerated herein is to provide a car crushing and lifting attachment in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof wherein like numerals refer to like parts throughout.

DESCRIPTION OF THE PREFERRED EMBODIMENT

Figure 1:
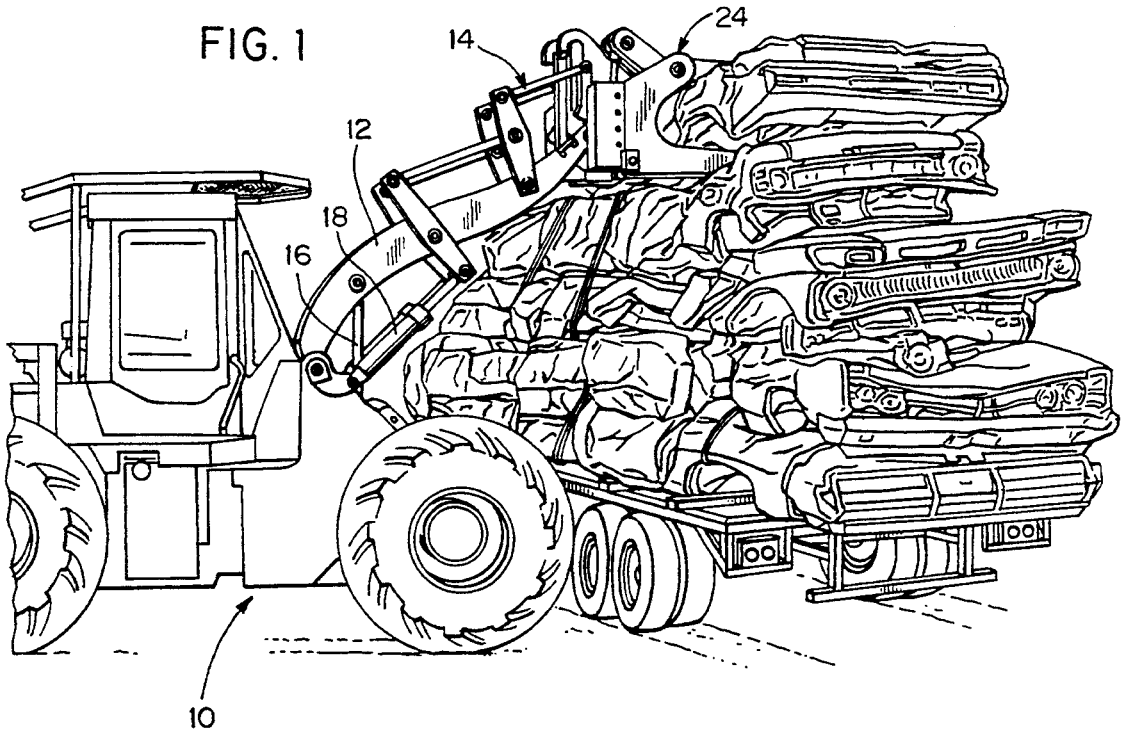
FIG. 1 is a perspective view of a typical form of wheeled front loader of the articulated type and with the car crushing and loading attachment of the instant invention operatively mounted from the free ends of the lift arm of the loader and being utilized to place a crushed vehicle on the top of a stack of crushed vehicles disposed upon a transport vehicle.
Figure 2:
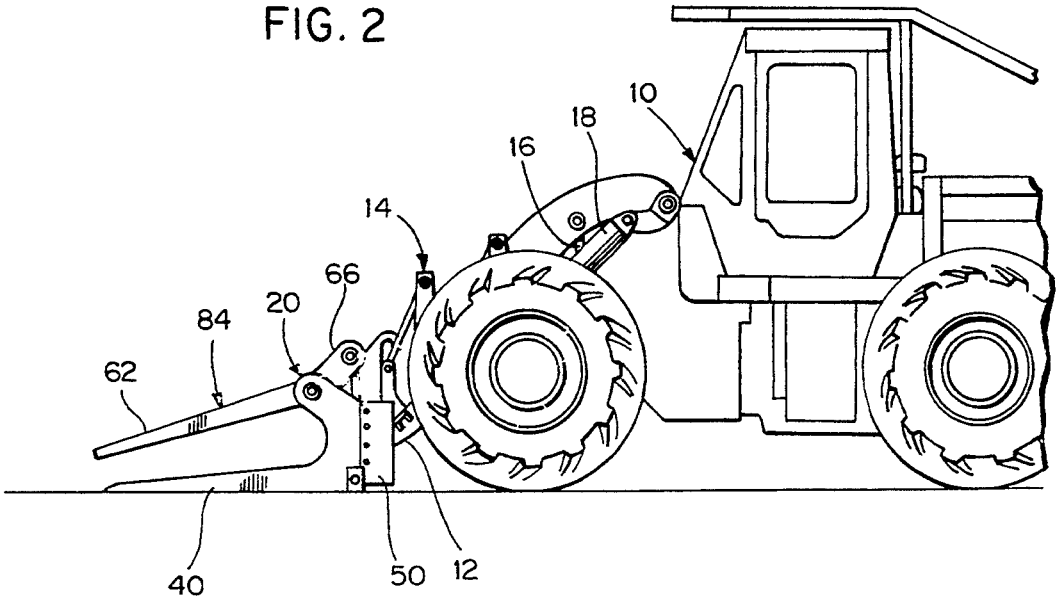
FIG. 2 is a fragmentary side elevational view of the front loader as seen from the left side thereof and with the lift arms of the front loader sufficiently lowered to the ground to place the supported car crushing and loading attachment of the instant invention upon the ground.

Referring now more specifically to the drawings the numeral 10 generally designates a conventional form of wheeled front loader of the articulated type including a pair of forwardly projecting lift arms 12 having a parallelogram load stabilizing arm assembly 14 operatively associated therewith.

A pair of hydraulic cylinders 16 are provided and operatively connected between the frame of the front loader 10 and the lift arms 12 thereof for raising and lowering the latter while a second pair of hydraulic cylinders 18 are operatively connected between the frame of the front loader 10 and the stabilizing arm assembly 14 thereof.

Figure 4:
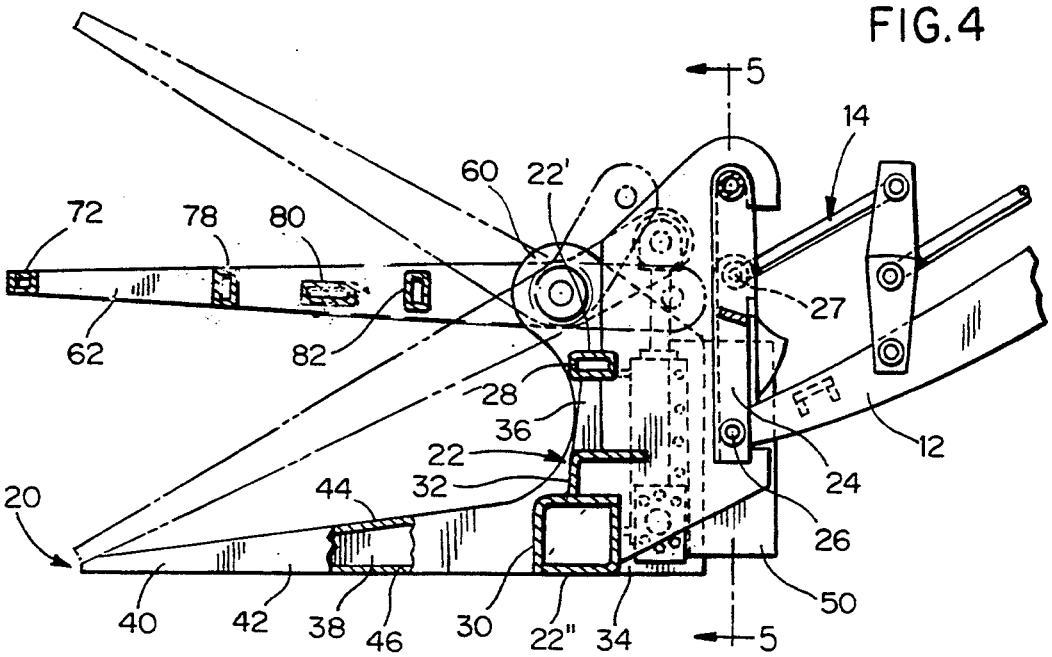
FIG. 4 is a vertical longitudinal sectional view taken substantially upon the plane indicated by the section line 4—4 of FIG. 3.
Figure 5:
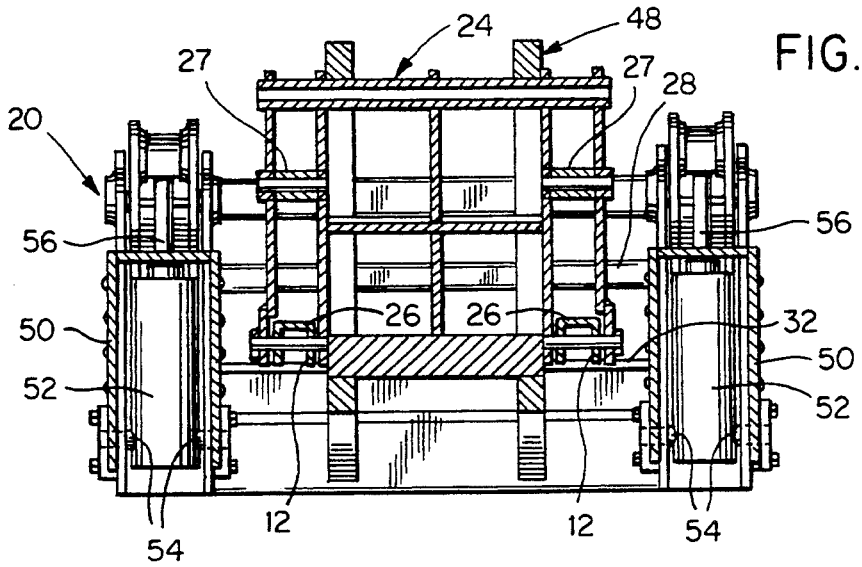
FIG. 5 is a transverse vertical sectional view taken substantially upon the plane indicated by the section line 5—5 of FIG. 4.

As shown in FIG. 4, the car crushing and loading attachment of the instant invention is referred to in general by the reference numeral 20 and includes a main transversely extending upright frame 22 defining upper and lower portions 22' and 22'' and with which a coupler assembly referred to in general by the reference 24 is releasably coupled, the coupler assembly 24 including a lower portion pivotally supported from the lift arms 12 as at 26 and an upper portion pivotally supported from the arm assembly 14 as at 28. In this manner, with the coupler assembly releasably engaged with the frame 22, the frame 22 is supported from the lift arms 12 and stabilized by the arm assembly 14.

The frame 22 includes upper, lower and intermediate height transverse portions 28, 30 and 32 extending and secured between rear portions of a pair of inner side plates 34, the transverse portions 28 and 32 being also interconnected by laterally spaced apart upstanding braces 36 extending and secured therebetween. The side plates 34 include forward extensions 38 comprising the inner side plates of a pair of forwardly projecting lower support arms 40, the support arms 40 also including outer side plates 42 as well as top and bottom plates 44 and 46 extending and secured between the plates 38 and 42. Thus, the support arms are fully boxed and project forwardly from lower opposite side marginal portions of the main frame 22. Each pair of corresponding side plates 34 and 42 define a corresponding side margin of the frame 22.

The coupler assembly 24 also includes a component 48 thereof supported and projecting rearwardly and upwardly from the rear of the main frame 22 and with which the coupler assembly 24 is releasably engagable. Also, an upstanding heavy gauge and forwardly opening channel member 50 is secured to and horizontally boxes in each pair of inner and outer side plates 34 and 42 rearwardly of the main frame 22 and the base end of the cylinder portion of an upstanding hydraulic cylinder 52 is pivotally supported between each pair of corresponding side plates 34 and 42 rearwardly of the frame 22 as at 54, each of the hydraulic cylinders including an upwardly projecting and upwardly extendable piston rod 56.

Figure 6:
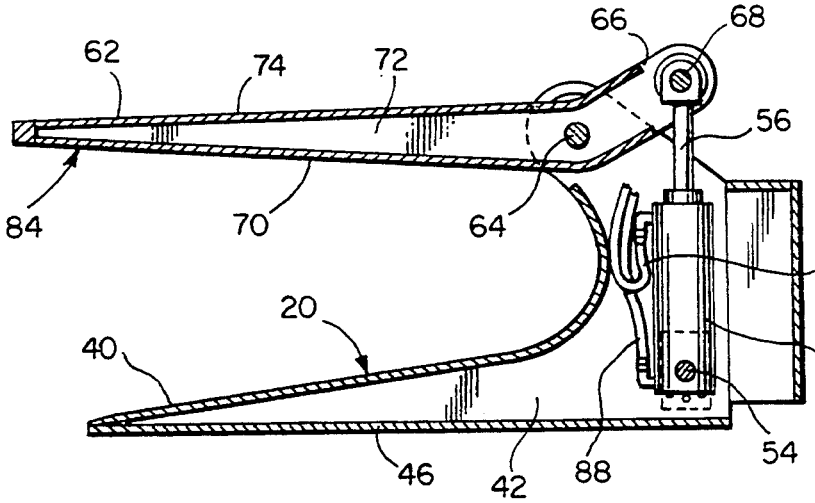
FIG. 6 is a vertical sectional view taken substantially upon the plane indicated by the section line 6—6 of FIG. 3.
Figure 7:
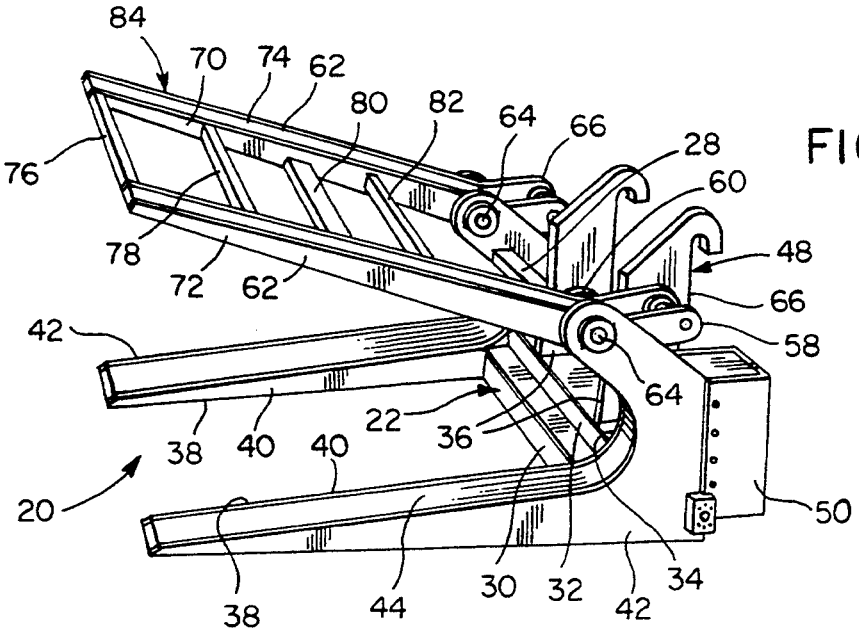
FIG. 7 is a perspective view of the car crushing and loading attachment.

With attention now invited to FIGS. 6 and 7, it may be seen that each pair of corresponding side plates 34 and 42 project considerably upwardly above the corresponding support arm as well as the adjacent end of the main frame 22. The upper portions of the plates 34 and 42 include forwardly and upwardly projecting extensions 58 and 60 between which a pair of upper crusher arms 62 are pivotally supported as at 64, each crusher arm 62 including a rearwardly and upwardly directed rear portion 66 between the side plates of which the upper end of the corresponding piston rod 56 is pivotally anchored as at 68.

It will be noted that the crusher arms not only include opposite side plates 70 and 72 as well as top and bottom plates 74, but also a plurality of elongated transverse bracing bars 76, 78, 80 and 82 extending and secured between the crusher arms 62 at points spaced longitudinally therealong. The crusher arms 62 and transverse bars 76, 78, 80 and 82 defining a crusher frame referred to in general by the reference numeral 84.

From FIG. 6 of the drawings it will be noted that each of the hydraulic cylinders 62 includes a pair of hydraulic lines 86 and 88 operatively connected thereto and it is to be understood that the remote ends of the lines 86 and 88 will be connected to the hydraulic system (not shown) of the front loader 10 through the utilization of suitable control valves whereby the crusher frame 84 may be selectively raised and lowered relative to the support arms 40.

Figure 3:
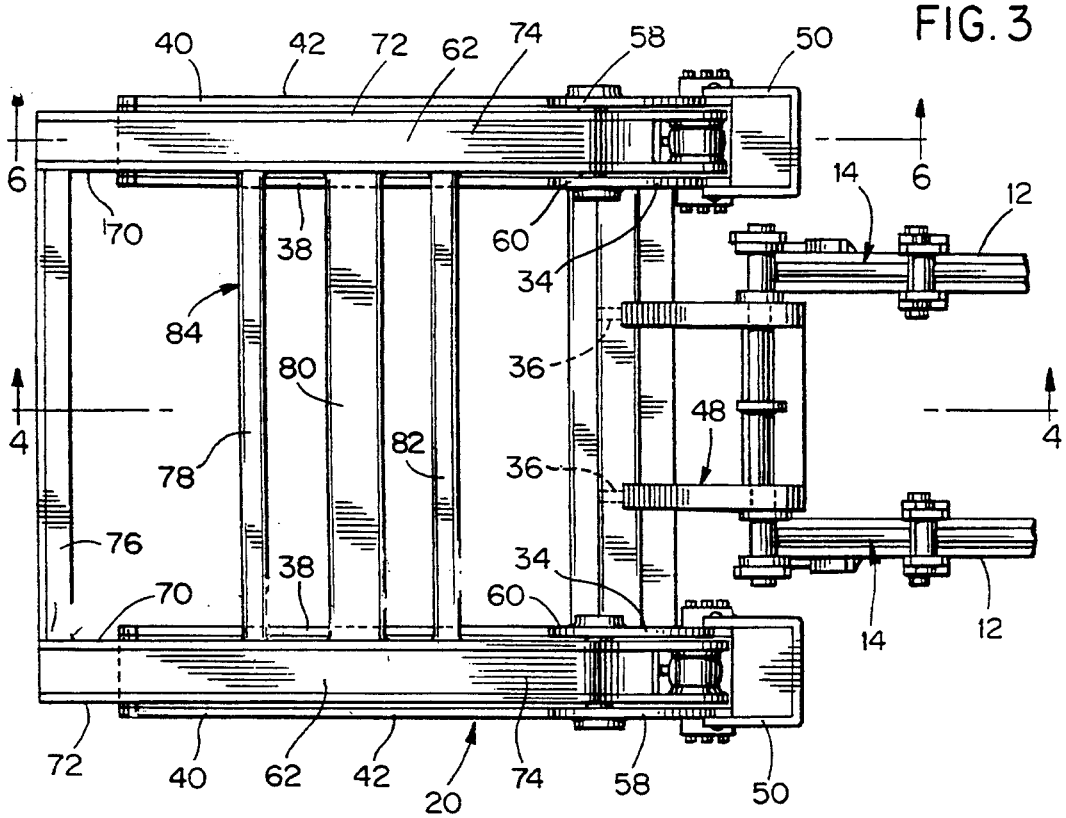
FIG. 3 is an enlarged top plan view of the car crushing and loading attachment.

With attention invited more specifically to FIG. 3, the component 48 may be differently configured according to the type of quick coupler assembly with which the attachment 20 is to be used. Further, the size of the attachment 20 and the rating of the hydraulic cylinders 52 thereof may be varied as desired. However, it is estimated that the total crushing tonnage of the attachment 22 will be between seventy-five and one hundred tons.

Considering that it is far easier to crush the top and other upper surfaces of a vehicle downwardly toward the level of the frame thereof than it is to attempt to upwardly crush the frame toward the upper surfaces of the vehicle and also that fact that the frame or lower portions of unibody vehicles are considerable stronger than the top and other upper surface portions of a vehicle, those portions of the attachment 20 which are to be received beneath the frame or lower unibody structure of a vehicle comprise the two support arms 40 while the upper surface portions of an associated vehicle to be downwardly crushed are opposed by the under side of the crushing frame 84 which offers considerably greater total contact area with the vehicle to be crushed than the support arms 40. In addition, the support arms 40 are free of reinforcing members extending and secured therebetween corresponding to the transverse bars 76, 78, 80 and 82 for a specific reason. The transverse bars 76, 78, 80 and 82 provide considerably more downwardly facing surface area to oppose the upper surfaces of a vehicle to be crushed downwardly towards the frame thereof. However, by maintaining the support arms 40 free of transverse braces extending and secured therebetween, the support arms 40 may be more readily slipped inwardly beneath a vehicle from either side or end thereof. This is particularly true if the wheels of the vehicle have been removed and the vehicle is disposed on soft ground and has sunk somewhat downwardly into the surface of the soft ground. If the lower support arms 40 were provided with cross bracing bars such as the bars 76, 78, 80 and 82, it would be difficult to push such a frame-like construction forwardly through the ground beneath the frame of a vehicle partially downwardly embedded in the ground. However, by utilizing only the pair of support arms, these forwardly tapering structures may be readily inserted inwardly beneath a vehicle even if the ground upon which the front loader 10 rests is very slippery from rain or snow. Once the support arms 40 have been inserted beneath a vehicle to be crushed from one side thereof while the crusher frame 84 is in the raised position, the hydraulic cylinders 52 may then be actuated to downwardly swing the crusher frame 84 in order to crush the upper surfaces of the engaged vehicle downwardly toward the lower frame portions thereof.

Inasmuch as the front loader 10 is capable of supporting and lifting considerable loads, FIG. 1 of the drawings illustrates the manner in which a crushed vehicle may be lifted and placed upon the top of a stack of crushed vehicles upon a transport vehicle. Of course, once the transport vehicle has been fully loaded and the stacked and crushed vehicles thereon have been secured in position, the transport vehicle may transport the crushed vehicle to a remote location.

The foregoing is considered as illustrative only of the principles of the invention. Further, numerous modifications and changes readily will occur to those skilled in the art, it is not desired to limit the invention to the exact construction and operation shown and described and, accordingly, all suitable modifications and equivalents may be resorted to, falling within the scope of the invention.

What is claimed as new is as follows:

1. A car crushing and loading attachment for a front loader, said attachment including an upstanding transverse frame defining front and rear sides, upper and lower portions and right and left margins, said rear side including coupler structure for removable coupling to the lift arms of a front loader, a pair of elongated, laterally spaced, opposite side lower support arms rigidly supported from said right and left margins and projecting generally horizontally forwardly from said lower portion, an upper crushing frame incorporating a pair of heavily reinforced, elongated and laterally spaced right and left crusher arms having front and rear ends and supported at said rear ends from said upper portion adjacent said right and left margins for angular displacement about a horizontal axis extending between and disposed generally normal to said crusher arms and extending between said left and right margins with said front ends projecting forwardly of said front side and vertically registered with said support arms, said rear ends projecting rearwardly of said rear side, and a pair of upstanding hydraulic cylinders having lower base ends pivotally supported from the rear side of said frame adjacent said right and left margins for oscillation about axes generally paralleling said axis and upwardly projecting and extendable piston shafts including upper ends pivotally anchored to said rear ends, said crushing frame including transverse connecting bars extending and secured between said crusher arms at points spaced longitudinally along said front ends forwardly of said axis, the front ends of said support arms being free of transverse members extending therebetween.

2. The attachment of claim 1 wherein said rear ends of said crusher arms disposed rearward of said axis are inclined rearwardly and upwardly relative to said front ends.

3. The attachment of claim 1 wherein said right and left margins of said frame include rearwardly projecting horizontally boxed reinforced portions, said cylinders being disposed in said horizontally boxed reinforced portions.

4. The assembly of claim 1 wherein said lower support arms are forwardly tapered in height.

5. The assembly of claim 4 wherein said rear ends of said crusher arms disposed rearward of said axis are inclined rearwardly and upwardly relative to said front ends.

6. The assembly of claim 5 wherein said right and left margins of said frame include rearwardly projecting horizontally boxed reinforced portions, said cylinders being disposed in said horizontally boxed reinforced portions.

7. The assembly of claim 1 wherein said transverse frames includes at least three vertically spaced transverse members extending and secured between said right and left margins and upstanding bracing means extending and secured between each pair of vertically adjacent transverse members.

* * * * *